United States Patent [19]

Gustafsson

[11] 4,028,750

[45] June 14, 1977

[54] COVER FOR WATER-FILLED OUTDOOR SWIMMING POOLS

[75] Inventor: Erik G. Gustafsson, Stocksund, Sweden

[73] Assignee: Barracudaverken Aktiebolag, Sweden

[22] Filed: Dec. 2, 1975

[21] Appl. No.: 636,828

[30] Foreign Application Priority Data

Dec. 5, 1974 Sweden ..... 7415255

[52] U.S. Cl. ..... 4/172.12

[51] Int. Cl.[2] ..... E04H 3/16; E04H 3/18; F16L 22/02

[58] Field of Search ..... 4/172, 172.11, 172.12, 4/172.13, 172.14

[56] References Cited

UNITED STATES PATENTS

| | | | |
|---|---|---|---|
| 3,072,920 | 1/1963 | Yelliott | 4/172.12 |
| 3,184,764 | 5/1965 | West | 4/172.12 |
| 3,313,443 | 4/1967 | Dial et al. | 4/172.12 X |
| 3,872,522 | 3/1975 | Bennett | 4/172.12 |
| 3,940,809 | 3/1976 | Hughes | 4/172.12 |

*Primary Examiner*—Henry K. Artis
*Attorney, Agent, or Firm*—Roylance, Abrams, Berdo & Kaul

[57] ABSTRACT

A buoyant swimming pool cover in the form of a flexible lightweight sheet comprising a large plurality of hollow buoyancy cells spaced apart over the sheet, there being a plurality of drain apertures distributed over the sheet in areas thereof not occupied by the buoyancy cells and serving to allow rain water to flow through the cover into the pool. Best results are achieved when the configuration of the upper surface of the cover presents depressions serving to direct into the drain apertures any water falling onto the cover. Advantageous embodiments are in the form of a lamination of at least two polymeric films at least one of which has been thermoformed to provide generally cup-shaped portions which are closed by another of the polymeric films. Since water cannot collect in any substantial quantity on the cover, the cover can be very lightweight and is always easily lifted off the water, without any dirt or debris which has collected on the cover being carried into the pool as the cover is removed.

10 Claims, 6 Drawing Figures

COVER FOR WATER-FILLED OUTDOOR SWIMMING POOLS

BACKGROUND OF THE INVENTION

Outdoor swimming pools present a variety of maintenance problems. Some of these, such as heating of the water and removal of small dispersed particles by filtering, can be dealt with by automatic equipment requiring relatively little attention. However, removal of relatively large bodies, such as leaves and debris, must be accomplished by hand.

It has long been common practice to use protective covers to reduce the amount of leaves and debris entering the pool when the pool is not in use, such covers typically being in the from of a tarpaulin stretch over the pool or floating on the surface of the water. It has also been proposed to produce such a cover by welding together two relatively thin polymeric foils in such fashion that the cover has a large number of sealed evenly distributed buoyant air cushions or cells. In one such proposal, the upper surface of the cover is smooth, while the lower surface, facing the surface of the water, presents the cells so that the cells support the cover at a small distance above the surface of the water. Such a cover has the advantages of reducing loss of heat from the pool water through thermal radiation, particularly at night, and preventing leaves and other debris from reaching the surface of the pool water so long as the weather is dry and no significant water falls on the cover. When it rains, however, the rain water collects on the upper surface of the cover, forming large or small pools which make it difficult to lift the cover off the pool water. Further, the rain water washes away the dirt, leaves and other debris which has collected on top of the cover so that dirty water and debris are washed over the edges of the cover as the rain continues or as the cover is lifted off in order to clear away the debris.

OBJECTS OF THE INVENTION

A general object of the invention is to devise a buoyant cover for water-filled outdoor swimming pools which, though light in weight and highly buoyant, is not subject to the collection of significant quantities of water from rain or condensation.

Another object is to provide such a cover which at least satisfactorily minimizes the washing into the pool of dirt and debris which has collected on the cover.

A further object is to provide such a cover wherein features of configuration which serve to provide buoyancy and/or reenforcement also serve to confine rain water to aid in draining the same immediately into the pool.

Yet another object is to devise such a cover in which any water falling on the cover will be drained to the pool without carrying with it any particles or objects of substantial size.

SUMMARY OF THE INVENTION

Generally considered, pool covers according to the invention are in the form of a flexible sheet of size and shape to cover the water in the pool, the sheet having a plurality of hollow buoyancy cells spaced apart and distributed over the sheet to provide the sheet with an overall positive buoyancy adequate to support the sheet on the surface of the water in the pool, there being a plurality of drain apertures spaced apart and distributed over the sheet, in areas thereof not occupied by the buoyancy cells, for passage of rain water through the sheet. Particularly advantageous embodiments include means, either in the form of elongated reenforcing elements or in the form of inverted pockets forming part of the buoyancy cells, defining depressions on the upper side of the sheet, which depressions are located and shaped to direct rain water into the drain apertures.

DRAWINGS

In order that the manner in which the foregoing and other objects are achieved according to the invention can be understood in detail, particularly advantageous embodiments thereof will be described with reference to the accompanying drawings, which form a part of the original disclosure of this application, and wherein FIG. 1 is a top plan view, with parts broken away for clarity, of a portion of a swimming pool cover according to one embodiment;

FIG. 5.

THE EMBODIMENT OF FIGS. 1 & 2

Figure 1:
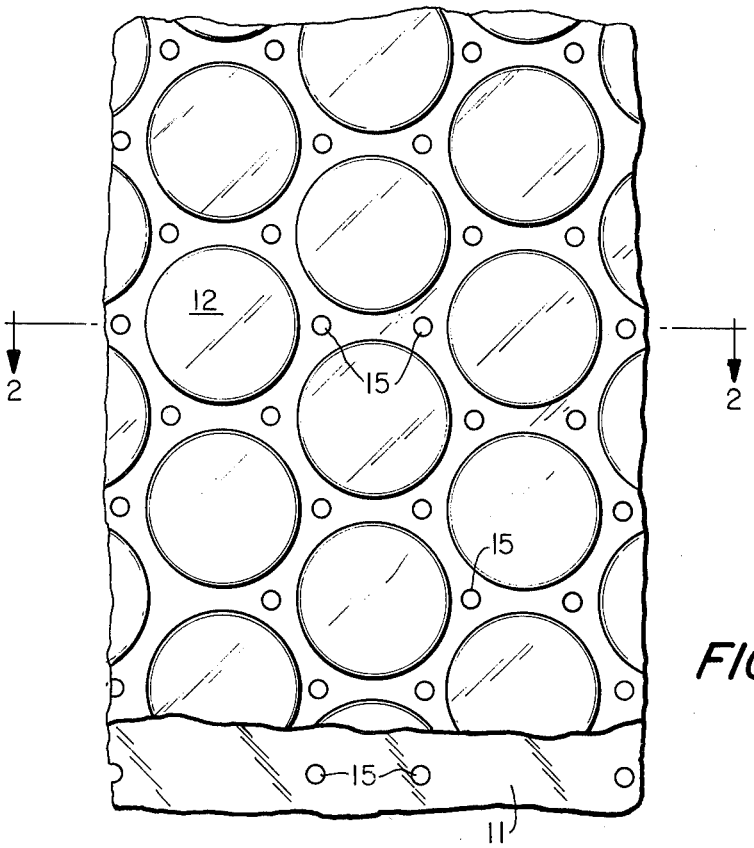

In this embodiment, the protective cover is in the form of a sheet made up of two films 10 and 11 which are welded together, film 11 being normally flat and forming the smooth upper side of the cover, and film 10 being formed with a plurality of cup-shaped shaped upwardly opening circular pockets 12. Film 11 extends across the tops of pockets 12, closing the pocket so that each pocket and the corresponding portion of film 11 constitutes a sealed air-cushion or buoyancy cell 13, FIG. 2. When the cover is spread on the surface of the water in a swimming pool, buoyancy cells 13 support the cover at a certain height above the surface 14, FIG. 2, of the swimming pool water.

Figure 2:
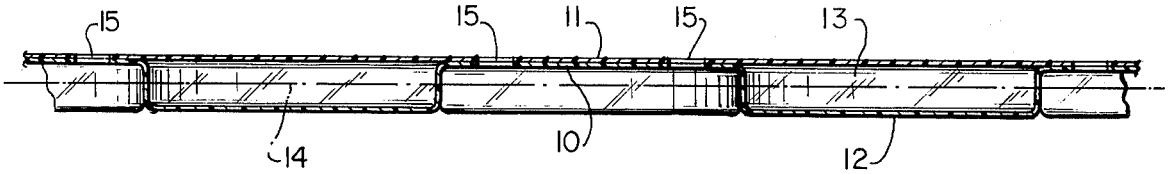
FIG. 2 is a transverse sectional view taken generally on line 2—2, FIG. 1.

As seen in FIG. 2, small holes or apertures 15 are provided in those areas of the two films 10, 11 between the buoyancy cells 13. It is these areas of the two films not occupied by the buoyancy cells, which are bonded or welded together, and the apertures 15 thus allow rain water, collecting on the upper surface of the cover when it rains, to pass freely through the cover into the pool. Accordingly, after rainy weather, the upper side of the cover will be generally free of rain water, and the cover can therfore be lifted freely and easily from the surface of the pool water.

From FIG. 2, it will be seen that the hollow buoyancy cells 13 provide the cover with an overall positive buoyancy such that the bonded, flat portions of flims 10 and 11 supported at a level spaced slightly above the surface 14 of the pool water.

THE EMBODIMENT OF FIGS. 3 & 4

In this embodiment films 10 and 11 are generally as in FIGS. 1 and 2, save that the pockets 12 are rectangular in plan, rather than circular. In addition, a third film 17 is employed, attached to the upper side of film 11 so as to constitute the upper side of the sheet 16. Between films 11 and 17 are a set of mutually parallel elongated reenforcing elements 18 and a second set of mutually parallel elongated reenforcing elements 19, elements 19 extending across elements 18 at right angles so that the two sets of reenforcing elements define the limits or edges of square depressions 20 on the upper side of the cover. A plurality of drain apertures 15 *a* are provided, each in the bottom of a different one of the depressions 20. Thus, rain water will collect in the depressions 20 and drain via apertures 15*a* into the pool, rather than running out at the edges of the cover. Particles of dirt and debris too large to pass through apertures 15*a* will be retained within the depressions 20 rather than being carried away at the edges of the cover.

To reduce the overall weight of the cover, the elongated reenforcing elements 18, 19 can be in the form of thin tubes, and the tubes can be glass fiber reenforced. Reenforcing elements 18, 19 can be of such nature as to increase the overall strength of the cover to such an extend that the cover is capable of carrying a person in the event of accidental fall into the pool, a feature of special importance in protecting against accidental drowning of children.

Figure 3:
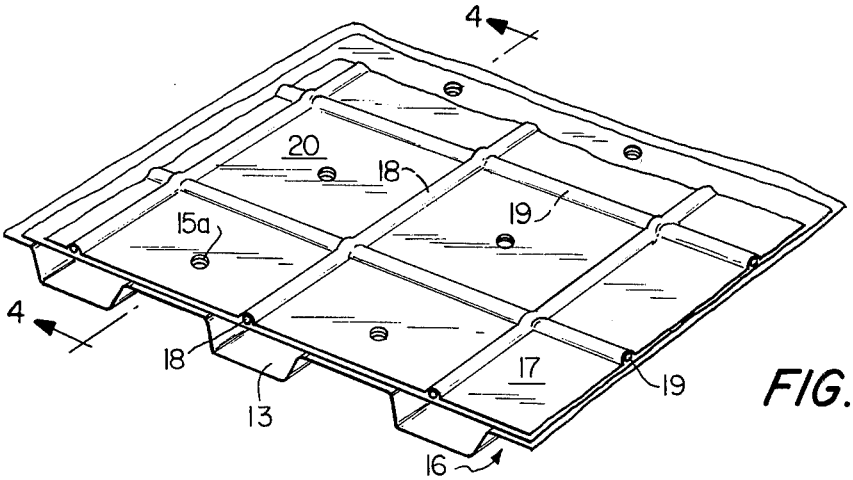
FIG. 3 is a perspective view of a portion of a pool cover according to another embodiment.

The cover has the advantage of being capable of being wound for storage on a drum located at one end of the swimming pool. In such case, it is advantageous to have elements 19, FIG. 3, in the form of relatively thick tubes closed at the ends so as to constitute buoyancy chambers and to also act as relatively strong reenforcing elements capable of catching a falling body. The spacing between the thick tubes 19 is then significantly greater than in FIG. 3 and can be, e.g., about 3dm. Reenforcing elements 18 are then made in the form of pliant polyester cords which are secured to the tubes 19 at the intersections. One end of each cord 18 can be attached to the winding drum (not shown) located at the end of the pool opposite the drum. The drum can be rotated by hand or by a motor drive, and the cover can be placed under limited tension by operation of the drum.

In this embodiment, the films can be reenforced in conventional fashion, and the combined strength of the tubes 19, cords 18 and reenforced films can be made such as to support an adult in the event of an accidental fall from the edge of the pool.

THE EMBODIMENT OF FIGS. 5 & 6

Figure 4:
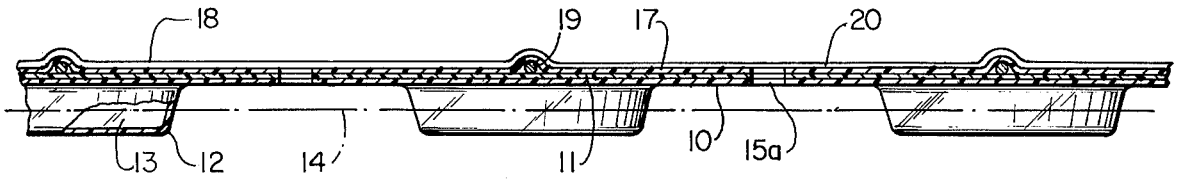
FIG. 4 is a transverse sectional view taken generally on line 4—4, FIG. 3.
Figure 5:
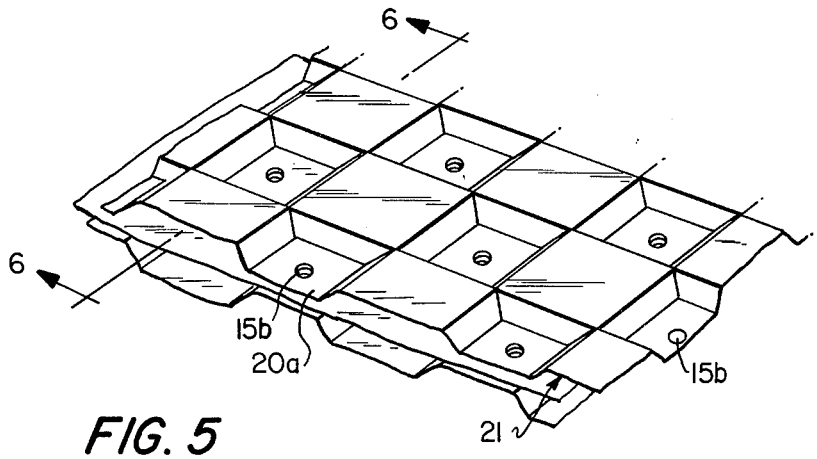
FIG. 5 is a perspective view of a portion of a pool cover according to yet another embodiment.
Figure 6:
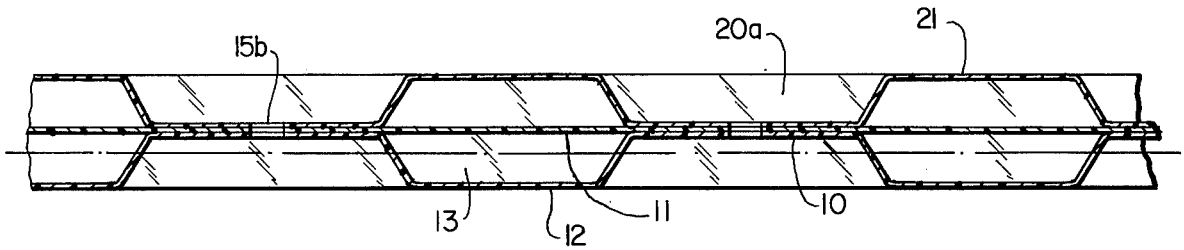
FIG. 6 is a transverse sectional view taken generally on line 6—6.

In this embodiment, the cover is in the form of a sheet composed of three films 10, 11 and 21. Film 10 is formed with rectangular pockets 12 in the same manner described with reference to FIGS. 3 and 4, and the films 10 and 11 are welded together in the spaces between pockets 21. Film 21 is formed in the same fashion as film 10, so as to present rectangular depressions 20*a* to provide the water collecting pockets on the upper side of the cover. One aperture 15*b* is provided, as shown, at the center of each depression 20*a* to drain rain water collected in the depressions directly through the cover into the pool. Covers according to FIGS. 5 and 6 can be reenforced with tubes and cords as hereinbefore described with reference to FIGS. 3 and 4.

Instead of being air-filled, the buoyancy cells 13 can be filled with foam plastic so that the cells retain their shapes better during use.

While particularly advantageous embodiments have been described for illustrative purposes, it will be apparent that various changes and modifications can be made without departing from the scope of the invention as defined by the appended claims.

What is claimed is:

1. A protective cover, for water-filled outdoor swimming pools, comprising a flexible sheet of size and shape to cover the surface of the water in the pool, said sheet comprising at least two thin, flexible polymeric films, a first one of said films having a plurality of laterally spaced pockets which depend from the film when the sheet is in place on the water in the swimming pool, another of said films overlying said first film so as to extend across said pockets and the portions of said first film which are not occupied by said pockets, said other film being secured to said portions of said first film to unite said first film and said other film and to seal against entry of water into said pockets, said pockets, thus sealed, constituting hollow buoyancy cells spaced apart and distributed over the sheet to provide the sheet with an overall positive buoyancy adequate for support of the sheet on the surface of the swimming pool water with the portions of said first film which are not occupied by said pockets then being supported at a level spaced slightly above the surface to the swimming pool water, there being a plurality of drain apertures spaced apart and distributed over the sheet in areas thereof not occupied by said buoyancy cells, for passage of rain water downwardly through the sheet.

2. A swimming pool cover according to claim 1, wherein the side of the sheet which is up when the cover is in place is defined by a thin, flexible polymeric film formed with a plurality of inverted pockets similar in plan shape and dimension to said dependent pockets of said first film; and said inverted pockets are each registered with a different one of said dependent pockets.

3. A swimming pool cover according to claim 2, wherein said film which is formed with said inverted pockets is a third film, and said first film, said other film and said third film are bonded together in areas of the sheet not occupied by said pockets.

4. A protective cover, for water-filled outdoor swimming pools, comprising a flexible sheet of size and shape to cover the surface of the water in the pool, said sheet having a plurality of hollow buoyancy cells spaced apart and distributed over the sheet to provide the sheet with an overall positive buoyancy adequate for support of the sheet on the surface of the swimming pool water, said buoyancy cells having a substantial thickness and projecting from that side of the sheet which will be down when the cover is in place, the other side of said sheet being formed with depressions and carrying a plurality of elongated reenforcing elements which are arranged to form ridges which define the edges of said depressions, there being a plurality of drain apertures spaced apert and distributed over the sheet, with at least one of said apertures being located within each of said depressions, whereby water falling on the sheet is directed into said apertures and will pass downwardly through the sheet.

5. A swimming pool cover according to claim 4, wherein said side which is down when the cover is in place is defined by a first thin, flexible polymeric film formed with a plurality of dependent pockets, each of said pockets defining the bottom and side walls of one of said buoyancy cells; and said other side of the sheet is formed by a second flexible polymeric film, said reenforcing elements being disposed between said first and second films.

6. A swimming pool cover according to claim 5 and further comprising a third flexible polymeric film disposed between said first film, on the one hand, and said second film and said reenforcing elements, on the other hand, the portions of said first film between said pockets being bonded to one surface of said third film, the portions of said second film between said reenforcing elements being bonded to the other surface of said third film.

7. A swimming pool cover according to claim 6, wherein said reenforcing elements are arranged to form a first set of mutually parallel reenforcing elements and a second set of mutually parallel reenforcing elements, said first set of reenforcing elements extending across the elements of said second set, whereby said reenforcing elements define a plurality of polygonal depressions, the plan dimensions of said depressions being larger than the plan dimensions of said pockets.

8. A swimming pool cover according to claim 7, wherein said first set of reenforcing elements extends at right angles to the reenforcing elements of said second set; and each reenforcing elements of one said sets extends across the tops of a series of said pockets.

9. A swimming pool cover according to claim 7, wherein the reenforcing elements of one of said sets are hollow tubes of significant diameter.

10. A swimming pool cover according to claim 3, wherein said pockets are rectangular and arranged in a plurality of straight series with the pockets of each series being spaced apart and with adjacent series being stagged so that each pocket of one series is located beside the space between two adjacent pockets of the next series.

* * * * *